US005304327A

United States Patent [19]

Welker et al.

[11] Patent Number: 5,304,327

[45] Date of Patent: Apr. 19, 1994

[54] MERCAPTAN INJECTION APPARATUS FOR USE WITH A PIPELINE

[75] Inventors: Brian H. Welker; Thomas S. Green, both of Sugarland, Tex.; Richard O. Lee, Chelsea, Mich.

[73] Assignee: Welker Engineering, Inc., Sugarland, Tex.

[21] Appl. No.: 882,046

[22] Filed: Jul. 13, 1992

[51] Int. Cl.[5] ..... B01F 3/04

[52] U.S. Cl. ..... 261/66; 261/97

[58] Field of Search ..... 261/DIG. 17, 97, 66

[56] References Cited

U.S. PATENT DOCUMENTS

| | | | |
|---|---|---|---|
| 725,086 | 4/1903 | Jacobs | 261/DIG. 17 |
| 1,042,864 | 10/1912 | Winks | 55/259 |
| 1,100,751 | 6/1914 | Lindstrom | 261/DIG. 17 |
| 2,157,074 | 5/1939 | Ericson | 261/66 |
| 2,180,584 | 11/1939 | Green et al. | 261/DIG. 17 |
| 2,617,685 | 11/1952 | Scruggs | 261/97 |
| 2,792,073 | 5/1957 | Boss | 261/97 |
| 3,510,112 | 5/1970 | Winquist et al. | 261/66 |
| 3,634,053 | 1/1972 | Klass et al. | 261/DIG. 17 |
| 4,369,115 | 1/1983 | Bauer | 261/66 |
| 4,442,047 | 4/1984 | Johnson | 261/66 |

*Primary Examiner*—Tim Miles
*Attorney, Agent, or Firm*—Gunn & Kuffner

[57] ABSTRACT

An elongate mercaptan injection apparatus is disclosed. From the remote end, there is an external fitting for connection with a supply line of liquid mercaptan. It communicates serially with an internal check valve captured in a chamber. The check valve includes a spring and ball cooperative with a valve seat. Through the check valve, the liquid mercaptan flows into an elongate hollow tubular member which is sealed externally with a number of fittings to prevent leakage. It extends to the interior of the pipeline through a fitting which seals to the wall of the pipeline. On the interior, it connects with an elongate hollow member packed with particulate material. A number of transverse openings provide cross ventilation so that flowing natural gas is able to pass through the particulate material. The liquid mercaptan is provided to the surfaces of the particulate material to provide an enhanced area which is moistened by the mercaptan liquid, and the flowing natural gas vaporizes the liquid to provide the proper odorization.

8 Claims, 1 Drawing Sheet

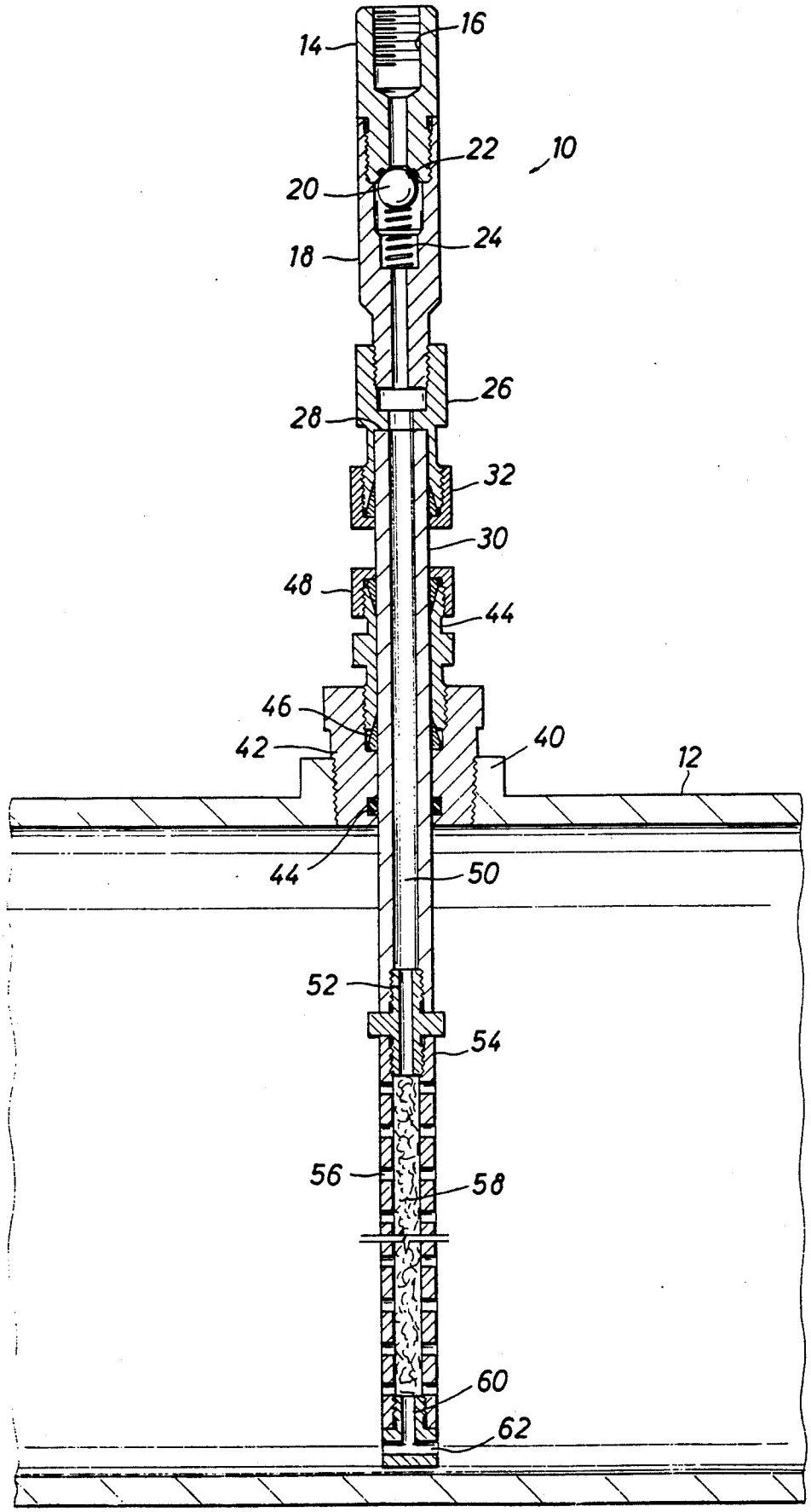
14
16
22
10
20
24
18
26
28
32
30
48
44
46
42
40
12
44
50
52
54
56
58
60
62

MERCAPTAN INJECTION APPARATUS FOR USE WITH A PIPELINE

BACKGROUND OF THE DISCLOSURE

The present apparatus is directed to a mercaptan injection mechanism and particularly one which is used with pipeline. Pipelines delivering natural gas primarily carry methane and only a few heavier molecules. Ordinarily, the gathering lines in a natural gas field deliver the flowing natural gas products to separation equipment which removes the heavier molecules such as butane or pentane. The primary constituents therefore delivered into a natural gas pipeline system are methane which is $CH_4$, perhaps trace amounts of $CO_2$ and perhaps some $N_2$. This readily combustible natural gas flow is odorless. Ordinarily, the odorless natural gas is delivered by high pressure, large diameter pipelines extending hundreds of miles to local municipal distribution systems. At the local system, the odorless natural gas is provided with an odorant which is ordinarily in liquid form but which vaporizes in the flowing natural gas. This odorant is thus injected after delivery from a large diameter pipeline into a local distribution system which is then delivered through neighborhoods by small lines ultimately ending up in very small gas lines. Because the possibility of leaks increases with the number of lines and connections, most natural gas leaks occur in such populated areas so it is essential that an odorant be added in the local distribution system.

Distribution of liquid mercaptan into a high pressure line requires that the mercaptan vaporize to be distributed in the flowing natural gas. If the gas velocity is quite high, vaporization is accomplished rather easily. However, there are slack moments such as a warm day in the midst of the winter when the gas flow may actually become quite slow. Then, the liquid mercaptans which are otherwise introduced into the pipeline may form a puddle in the pipeline and not vaporize. Then when the gas flow does increase in velocity, the liquid may vaporize almost excessively for a particular flow rate of natural gas. Inevitably, this creates an irregular odorant mix in the flowing natural gas which creates problems. The odorant may be too mild in fragrance to be noticed in the event of a leak. On the other hand, the puddle may be vaporized rather quickly and create an excessively strong odorant dose, thereby creating undue alarm with just even a modest use of natural gas in an open flame. The fragrance spreads too readily if the concentration of the mercaptan in the natural gas is excessively high.

The present apparatus sets forth a mercaptan injection apparatus which particularly takes advantage of the ability of the mercaptan to vaporize in the flowing natural gas. The present apparatus is particularly able to do this by incorporating a large surface area which is exposed to the liquid mercaptan because the large area is coated in the liquid mercaptan. This enhances the delivery of the mercaptan into the natural gas by making it more easily vaporized. The large surface area boosts the vaporization process so that the mercaptans are vaporized substantially when introduced. This reduces the tendency of the newly added mercaptans to form a puddle and to otherwise retard the vaporization and distribution of the odorant material added to the natural gas.

The present apparatus is an injection mechanism which is adapted to be installed in a middle sized natural gas flow line. For instance, a very large natural gas line may deliver natural gas to a region perhaps 800 miles from the wells where the natural gas is produced. In that region, the number and size of the natural gas subscribers in the local distribution network may require a lateral line of four inches from the large transcontinental pipeline. A lateral line of four inches is typically the location at which mercaptans are then injected. It is not common to introduce the mercaptan into the large pipeline. Rather, the local distribution main is targeted for this purpose. In this instance, the local distribution line of four inches serves as a mounting for the mercaptan injection apparatus of the present disclosure. Primarily, it includes a fitting which connects with a mercaptan supply line delivering liquid mercaptan under pressure, a ball and spring in a closed cavity serially connected with a fitting which functions as a check valve which is responsive to pipeline pressure, seals and fittings connected with an elongate hollow tube, the tube being positioned axially through a threaded plug supporting internal seals for preventing leakage therearound wherein the rod extends into the pipeline. The tube defines an axial passage along the length of it and at its distal portions, the tube is perforated with a number of openings. This defines an internal cavity which is filled with wool such as metal shavings or fibrous plastic shavings. Mercaptan which is delivered through the elongate tube flows through the lower end of it and into contact with the wool particles and provides mercaptan wetting over a greater area. Perforations introduce pipeline gas flow into the cavity supported at the end of the tube. This spreads the liquid mercaptan over a much greater surface area than would otherwise occur by simple drip feeding. This enables distribution of vaporized mercaptan liquid into the flowing natural gas without creating a liquid accumulation in the pipeline.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single drawing is a sectional view through the mercaptan injection apparatus of the present disclosure showing an exposed end which is connected with a mercaptan supply line and further incorporating a check valve connected with an elongate valve extending into the pipeline and further illustrating randomly shaped particles which hold the mercaptan on the surface to provide enhanced surface spreading of the mercaptan during introduction into the flowing natural gas.

DETAILED DESCRIPTION OF THE PREFERRED EMBODIMENT

Attention is first directed to the only drawing where the mercaptan apparatus of the present disclosure is identified by the numeral 10. It is attached to the pipeline 12 typically of substantial size such as a six inch nominal diameter pipe carrying natural gas at substantial pressures, e.g. 750 psi or more. Typically, this quantity of natural gas is delivered to a small town or a large neighborhood in a bigger city and is distributed in that region by a number of smaller lines extending to the factories, apartment houses, schools and residential neighborhoods. Typically, the line 12 will deliver the natural gas at relatively high pressure and the pressure will be reduced down stream of the present apparatus by means of pressure regulators and the like. In this typical circumstance, the natural gas is odorless as supplied but the odorant that is added by the present apparatus is viewed as a safety mechanism so that leaks in the populated areas can be detected by odor. Quite obviously, it is desirable that the odorant be provided in an amount that is proportioned to the natural gas volume delivered through the pipe 12.

Continuing further, a supply line from a tank of mercaptan delivered under pressure is connected at a fitting 14 which is internally threaded at 16 so that the mercaptan line delivers a continuous flow of liquid mercaptan under pressure into the injector 10. The fitting 14 is threaded to a housing 18 which encloses a spherical valve element 20. The valve element is held against the valve seat 22 by means of a spring 24. The spring force and line pressure determine the amount of pressure which is required upstream of the check valve mechanism to overcome the valve spring, thereby forcing it open, and introducing mercaptan flow into the remainder of the structure. The housing 18 tapers to a narrow end, and threads to an internally tapped fitting 26. The fitting 26 is constructed with an internal shoulder 28 which enables an elongate tube 30 to be forced into the fitting and positioned snuggly against the shoulder 28. A seal locking nut 32 is positioned on the exterior and captures a seal internally to prevent leakage along the tubular member 30.

The pipeline is provided with an upstanding collar which is internally threaded. The collar 40 is positioned preferably at the top side of the pipeline to receive the elongate hollow tubular member 30 through it. This uses gravity dripping as will be explained. The tube 30 is held in place by means of a threaded insert 42 which threads to the surrounding collar defining the opening into the pipeline. The threaded lock member 42 captures an internal seal ring 44. The seal ring 44 prevents leakage from the pipeline to the exterior. The installation is made tight and leak proof by means of a threaded fitting 44 which is positioned for threaded engagement, thereby securing a seal ring 46 adjacent to the tubular member 30 and threading tightly to convert the urge into a ring loaded structure which grips snuggly and prevents leakage. The fitting 44 supports a threaded cap 48 which locks at the top or upper end thereof.

The elongate tubular member 30 is gripped by the fitting 42 which is positioned around it and threadedly engages the upper fitting 44. This defines a method of holding the device so that it is inserted into the pipeline to the proper depth. The depth of insertion is determined by a number of factors; primarily, selected areas along the length of the tubular member 30 are installed to position very little or much more of the exposed surface on the exterior.

The present apparatus 10 is installed in a pipeline equipped with the fitting 40. The fitting 44 is fastened and made tight around the elongate hollow member 30. Threading assures proper connection. Once the proper connection has been made, the feed line is connected to the threaded fitting 16 and the equipment is then made ready for operation in the vertical orientation as illustrated in the drawings. It is upright so that the mercaptan flows down the central passage 50. The passage 50 delivers the mercaptan to a metering orifice 52. In turn, the metering orifice is constructed and arranged with a threaded nipple at the lower end which engages a perforated tube section 54. The perforate tube has a number of openings at 56 which extend through the sidewall. The interior is packed with stainless steel wool material 58 of Teflon shavings. The wool material 58 is included for holding the liquid as will be explained. The liquid mercaptan flows through the passage 50 and is metered by the orifice 52. It is delivered to the check valve by means of upstream pressure from the mercaptan pumping system. It is permitted to drip steadily along the passage 50 and through the orifice 52 to thereby impinge on the particles 58 which make up the wool packing. This flow of liquid mercaptan wets the surface areas of the particulate material 58 so that all sides of the shredded members are made wet. As mentioned, the preferred form of material can be steel wool, shredded teflon (a trademark of the E.I. DuPont Company) or other materials which are readily shredded. The shredded materials are packed in the upstanding hollow tubular member just below the metering orifice. This enables the flowing liquid mercaptan to distribute and collect on the surfaces. This accumulation is exposed to an enhanced gas flow by virtue of the many perforations which introduce the flowing natural gas into and around and in the vicinity of the wool particulate material. This then enhances the interchange of the liquid mercaptan with the flowing gas so that vaporization readily occurs.

The lower end of this elongate cylindrical chamber is closed by means of a fitting 60 which threads at the lower end and which has a very small passage in it. This passage 62 serves as the bottom most performation to introduce gas flow.

Liquid mercaptan product is delivered under pressure to this illustrated equipment. The pressure must be sufficient to overcome the check valve 20 which requires compression of the coil spring 24. Moreover, this is included for the express purpose of assuring that the flow of mercaptan is delivered at the requisite positive pressure for mixing in the flowing natural gas. The flow of the natural gas along the pipeline 12 picks up liquid mercaptan as the natural gas flows through the perforations 56. Ideally, the perforations are aligned so that the natural gas flow is directed through the multiple perforations and into the particulate packed material which is enclosed in the perforated tube 54. The flowing natural gas is able to pick up and carry along with it the vaporized liquid mercaptan. This vaporization dispenses the odorant through the flowing natural gas to assure that a proper concentration of odorant is accomplished. The anticipated rate of flow through the pipeline 12 is normally known in advance, and the liquid mercaptan is introduced at a rate to assure proper odorant concentration in the natural gas. This concentration is obtained by delivery of the mercaptan to the packed particulate material so that the liquid percolates through the material while yet exposing the mercaptan to the enhanced flow of natural gas and thereby dispersing the odorant more uniformly notwithstanding variations in natural gas demand through the pipeline 12. The flowing natural gas provided by the pipeline 12 thus disperses the odorant through the cross section of the pipe without creating liquid puddles in the bottom. Moreover, this carries the vaporized mercaptan downstream so that it is able to be comingled properly with the natural gas and distributed in the immediate vicinity by the various and sundry distribution lines making up the natural gas delivery system.

The fitting 42 can be rotated to vary alignment of the perforations with the direction of flow in the pipeline. In using it in this fashion, it will serve as an index mechanism. It is also possible to vary the size and shape of the perforate tube 54. Easy insertion is obtained from the use of the cylindrical tube. If insertion is no problem, the tube 54 can be wider, e.g., as wide as the pipeline permits. One form can be a full width circular housing with a woven or felted fibrous sheet wicking the liquid mercaptan into the sheet.

While the foregoing is directed to the preferred embodiment, the scope thereof is determined by the claims which follow.

What is claimed is:

1. A liquid mercaptan dispensing apparatus for installation to odorize flowing natural gas in a pipeline comprising:

(a) a remote fitting adapted to be connected with a supply of liquid mercaptan delivered through a supply line;

(b) an elongate hollow tubular member connected with said fitting and adapted to direct liquid mercaptan flow axially through a passage in said member;

(c) means for supporting said elongate member mounted relative to a pipeline delivering natural gas wherein said means supports the distal end of said member interiorly of the pipeline;

(d) a serially arranged check valve in said supply line path for delivery of flowing liquid mercaptan so that said check valve provides a controlled back pressure to the liquid flow thereof; and (e) an elongate hollow chamber means for receiving liquid mercaptan through said elongate tubular member, said chamber means having multiple perforations therein so that, when positioned within the pipeline at a transverse position with respect to flow in the pipeline, flowing natural gas vaporizes liquid mercaptan therein, and wherein said chamber means is filled with particulate material to thereby provide an enlarged surface area for supporting liquid mercaptan.

2. The apparatus of claim 1 wherein said chamber means comprises an extension to said tubular member, and said perforations have the form of intercepting transverse holes to enable gaseous flow through said holes into the packed particulate matter therein.

3. The apparatus of claim 1 wherein said supporting means comprises:

(a) means attached to said pipeline;

(b) said means having a surrounding threaded collar; and (c) threaded means engaging said collar to position said hollow tubular member in sealed connection within said collar.

4. The apparatus of claim 3 including a seal means circularly positioned at said collar to prevent leakage therealong.

5. The apparatus of claim 1 wherein said chamber means comprises an elongate hollow tubular body with an upper end serially connected to said tubular member to enable gravity dripping into said chamber means.

6. The apparatus of claim 5 including a threaded closure means at an end of said chamber means.

7. The apparatus of claim 6 including a second closure means at a second end of said chamber means.

8. The apparatus of claim 7 including a metering orifice in one of said closure means to controllably flow mercaptan into said chamber means.

* * * * *